United States Patent [19]

Sprenger

[11] Patent Number: 4,870,806

[45] Date of Patent: Oct. 3, 1989

[54] METHOD AND APPARATUS FOR MONITORING THE SUPPLY OF CAP MEMBERS OF CAPPING MACHINES

[75] Inventor: Helmut Sprenger, Guldental, Fed. Rep. of Germany

[73] Assignee: Seitz Enzinger Noll Maschinenbau Aktiengesellschaft, Mannheim, Fed. Rep. of Germany

[21] Appl. No.: 277,706

[22] Filed: Nov. 30, 1988

[30] Foreign Application Priority Data

Dec. 3, 1987 [DE] Fed. Rep. of Germany ..... 3740991

[51] Int. Cl.[4] ..... B65B 57/08; B65B 57/18; B67B 3/26

[52] U.S. Cl. ..... 53/485; 53/72; 53/75; 53/506; 53/507; 53/508; 221/3; 221/6; 221/21

[58] Field of Search ..... 53/396, 485, 72, 75, 53/77, 507, 508, 505, 506; 221/6, 3, 21, 2

[56] References Cited

U.S. PATENT DOCUMENTS

| | | | |
|---|---|---|---|
| 3,228,169 | 1/1966 | Brown | 53/507 |
| 3,477,197 | 11/1969 | Budz | 53/508 X |
| 3,683,588 | 8/1972 | Ahlers | 53/77 X |
| 4,254,787 | 3/1981 | Watanabe et al. | 53/508 X |
| 4,312,172 | 1/1982 | Fisher et al. | 53/506 X |
| 4,498,275 | 2/1985 | Baron | 53/72 X |

*Primary Examiner*—Horace M. Culver
*Attorney, Agent, or Firm*—Becker & Becker, Inc.

[57] ABSTRACT

A method and apparatus for monitoring the supply of cap members from a magazine or supply bin, via a channel, to the capping mechanism of a capping machine. At least one signal emitter, which is provided at the channel, generates an emitted signal that changes as the cap members move past, with a disruption signal being derived from the emitted signal if this emitted signal does not change during a specified time interval. A cycle signal is derived from the working or machine cycle of the capping machine. If no change of the emitted signal is determined in two successive cycles, the sum of which correspond to a full period of the cycle signal, the disruption signal is generated.

17 Claims, 5 Drawing Sheets

A
B
C
$S_G$
$S_S$
$T_H$

METHOD AND APPARATUS FOR MONITORING THE SUPPLY OF CAP MEMBERS OF CAPPING MACHINES

BACKGROUND OF THE INVENTION

The present invention relates to a method and apparatus for monitoring the supply of cap members, for example crown corks, roll-on caps, or similar caps, from a magazine or supply bin, via a channel, to the capping mechanism of a capping machine, whereby at least one signal emitter, which is provided at said channel, generates an emitted signal that changes as the cap members move past, with a disruption signal being derived from the emitted signal if this emitted signal does not change during a specified time interval.

With capping machines for bottles or similar vessels, the members used for capping are generally supplied from a magazine or supply bin, via a channel, to the capping mechanism of the machine. In so doing, interruptions in the orderly supply of the cap members cannot always be prevented, for example if the cap members become jammed in the channel that serves for the supply or in the capping mechanism, if gap bridging of the cap members occurs in the supply bin, or, where the supply bin is not timely refilled, no cap elements, or only an insufficient number of such elements, pass from the supply bin into the channel that serves for the supply of these cap members. In order to prevent disruption of operation by having uncapped bottles or similar vessels leaving the capping machine, it is necessary to continuously monitor the orderly supply of the cap members to the capping mechanism.

To accomplish this monitoring, it was proposed in German Gebrauchsmuster No. 19 60 680 to provide an electrical signal emitter that generates a emitted signal on the channel that serves for the supply of the capping members. This emitted signal always has a first state when a cap member is located in the effective range of the signal emitter, and has a second state when no cap member is in the effective range of the signal emitter or if a gap exists between two cap members that directly follow one another in the channel and have their peripheries (for example crown edges) resting against one another. Using a timing or delay element, a disruption signal is then generated from this emitted signal in an electrical control device if, after a change of the emitted signal occurs within a time interval that is fixed by the timing or delay element, a renewed change of the emitted signal does not take place.

This heretofore known method and apparatus have the drawback that due to the time interval that is fixed by the timing or delay element, a reliable monitoring is possible only within an output range of the capping machine that corresponds to this time interval. In other words, if the output rate of the machine is considerably less, it is possible for a disruption signal to be released even though an orderly supply of cap members is taking place. On the other hand, if disruptions occur when the machine is operating at considerably higher output rates, the release of the disruption signal is significantly delayed, i.e. is effected only after several working or machine cycles after a large number of uncapped bottles are in the capping machine or have left the machine.

It is therefore an object of the present invention to provide a method and apparatus for monitoring the supply of cap members, with this method and apparatus avoiding the drawbacks of the heretofore known method and apparatus and assuring a reliable monitoring independent of the respective output rate of a given capping machine

BRIEF DESCRIPTION OF THE DRAWINGS

This object, and other objects and advantages of the present invention, will appear more clearly from the following specification in conjunction with the accompanying schematic drawings, in which.

SUMMARY OF THE INVENTION

Figure 1:
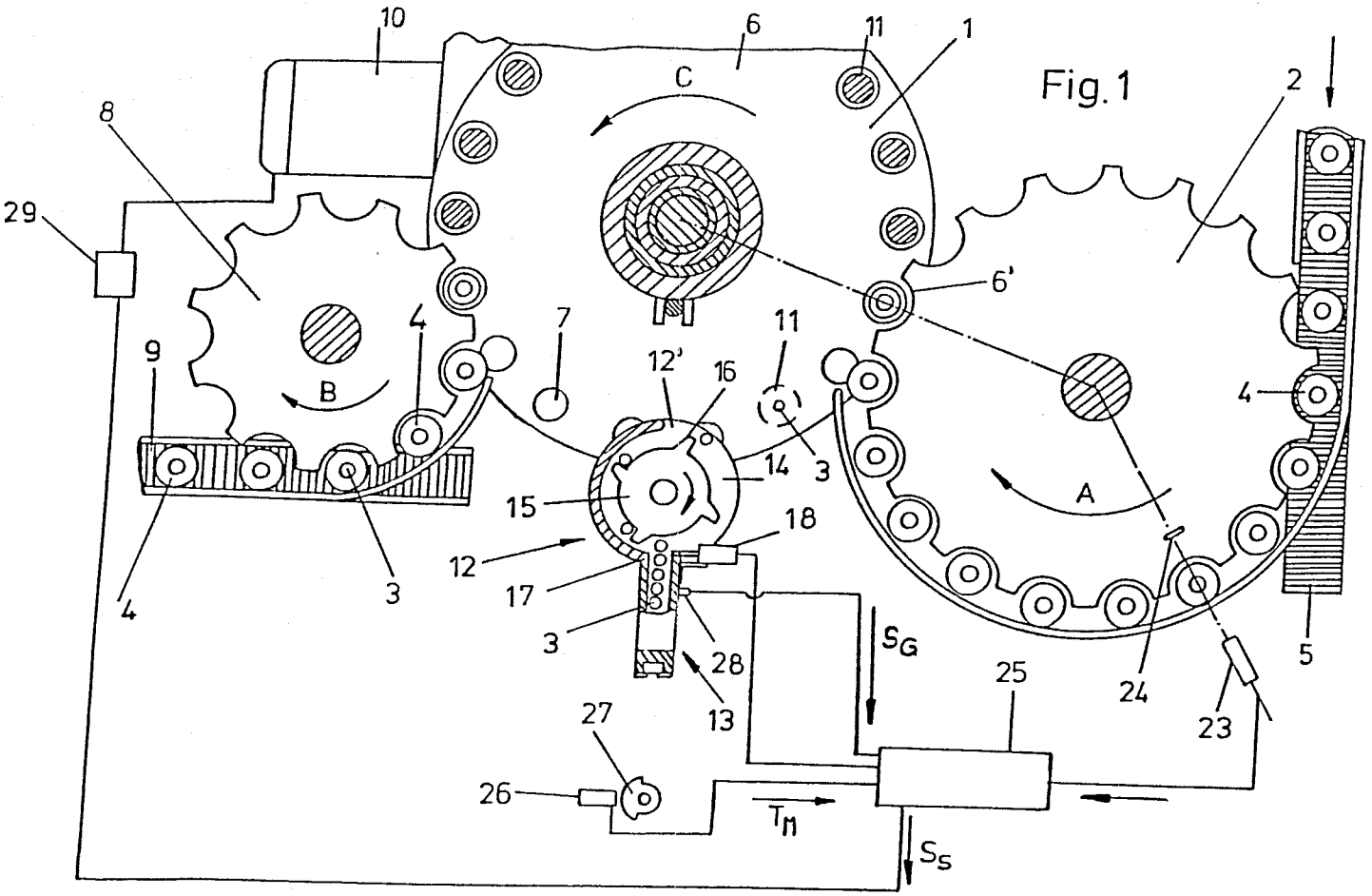
FIG. 1 is a plan view of a crown cork capping machine together with the cork transfer mechanism and the control device of the machine.

The method of the present invention is characterized by the steps of deriving from the capping machine a cycle signal that corresponds to the working or machine cycle of the machine, and generating the disruption signal if in two successive first and second cycles, the sum of which corresponds to a full period of the cycle signal, no change of the emitted signal is determined.

The apparatus of the present invention is characterized primarily by an electrical or electronic control device, and means for deriving from the capping machine a cycle signal, which corresponds to a working or machine cycle of the machine, and for supplying this cycle signal to the device, which then generates the disruption signal if in two successive first and second cycles, the sum of which corresponds to a full period of the cycle signal, the control device does not determine any change in the emitted signal.

Since with the inventive method and apparatus the monitoring mode is carried out dynamically and independent of the machine cycle, it is possible to have a reliable monitoring of the supply of the capping members independent of the respective machine rate, and hence especially also with extreme variations of this rate.

In order with the inventive method to be able to monitor not only the general movement of the capping members within the channel, but also at the same time to be able to monitor whether a capping member has actually completely passed the signal emitter provided at the channel during each complete period of the cycle signal, the inventive method and the inventive apparatus are preferably embodied in such a way that a disruption signal is only then not generated if within the two first and second cycles, the sum of which corresponds to a full period of the cycle signal, a double change in state of the emitted signal delivered by the signal emitter occurs, i.e., a change from the one state (for example low-level) into the other state (for example high-level), and subsequently back to the first state (for example low-level). This also means that the disruption signal will always be generated if in the two successive first and second cycles this double change of the emitted signal is not determined.

With the inventive method and apparatus, the evaluation of the emitted signals is effected in an electrical control device, preferably pursuant to a prescribed program.

It should be noted that the term "capping mechanism" very generally means that portion of a capping machine in which the capping members are finally placed and secured upon the containers or bottles that are to be capped, and in particular independent of how the capping members individually pass out of the channel and onto the bottles, in other words, especially independent of whether the capping members are placed directly upon the bottles from the channel via a shoe, as is generally the case with roll-on caps, or whether the capping members pass directly from the channel, or via a cork transfer mechanism, to the capping mechanism of the capping machine, and are then placed upon the bottles with this capping mechanism, as is generally the case with crown corks.

It should also be noted that within the context of the present application, the term "working cycle" refers to the period of time that elapses between the transfer of two cap members to two bottles that follow one another in the machine. Furthermore, within the context of the present invention the terms "machine cycle" and "cycle signal" refer to alternating voltage signals, preferably pulse signals, with a full period of the machine cycle in each case corresponding to a working cycle, and a full period of the cycle signal equaling a period of the machine cycle or, where the cap members are supplied in parallel via several channels provided on the capping machine, equaling a multiple of the machine cycle that corresponds to the number of these channels.

Further specific features of the present invention will be described in detail subsequently.

DESCRIPTION OF PREFERRED EMBODIMENTS

Referring now to the drawings in detail, the sealing or capping machine 1 illustrated in FIG. 1 is provided in a known manner at its inlet with a feed star 2 to which the bottles 4 that are to be capped with the corks 3 (crown corks) are supplied in an upright manner via a conveyer belt 5. The feed star 2 transfers these bottles 4 one after the other, at a spacing that corresponds to the machine spacing or operating cycle, to a machine table 6 in such a way that the bottom of each bottle 4 rests upon a deposit element 7 of the table 6.

In a similarly known manner, provided at the outlet of the capping machine 1 is a discharge star 8 via which the bottles 4 that have been capped with the corks 3 are removed from the bottle table 6 and are transferred to a conveyer belt 9 for the withdrawal of the capped bottles 4. By means of a common drive motor 10, the feed star 2, the discharge star 8, as well as the bottle table 6 are each synchronously driven about a vertical axis. In particular, in the embodiment illustrated in FIG. 1, the feed star 2 and the discharge star 8 are driven in a clockwise direction, i.e. in the direction of the arrow A or B respectively, and the machine or bottle table 6 is driven in a counterclockwise direction, i.e. in the direction of the arrow C.

Provided above the machine table 6 is a plate or a rotor that rotates along with the table 6 in the direction of the arrow C. This rotor, which is not illustrated in the drawing, supports the capping elements 11, a respective one of which is disposed above each deposit element 7. Between the discharge star 8 and the feed star 2, in the direction of rotation C of the machine table 6, the cork transfer mechanism 12, which in cooperation with the capping elements 11 forms the capping mechanism, is disposed below the path of movement of the capping elements 11. Via the cork transfer mechanism 12, the corks 3, which are supplied over a channel 13 in the correct processing position, are transferred one after the other to the capping elements 11 as they pass by the cork transfer mechanism 12.

In the illustrated embodiment, the cork transfer mechanism 12 is comprised, among other things, of a cork support 14, which is formed from a circular disk-like plate, and a disk or plate 15 that is driven synchronously with the machine table 6 about a vertical axis. Provided on the periphery of the plate 15, for the corks 3, are four tangs or drivers 16 that project beyond this periphery. Via a discharge opening 17, the corks pass one after the other out of the channel 13 to the cork transfer mechanism 12, and in particular into the region of the path of movement of the drivers 16. Carried along by the drivers 16, the corks 3 slide on the cork support 14 from the discharge opening 17 to a position 12' where each cork 3 is then removed by a respective capping element 11. Provided at the discharge opening 17 is an electrically actuatable closure member 18 that in a first position closes off the discharge opening 17, and in a second position releases the opening 17.

Figure 2:
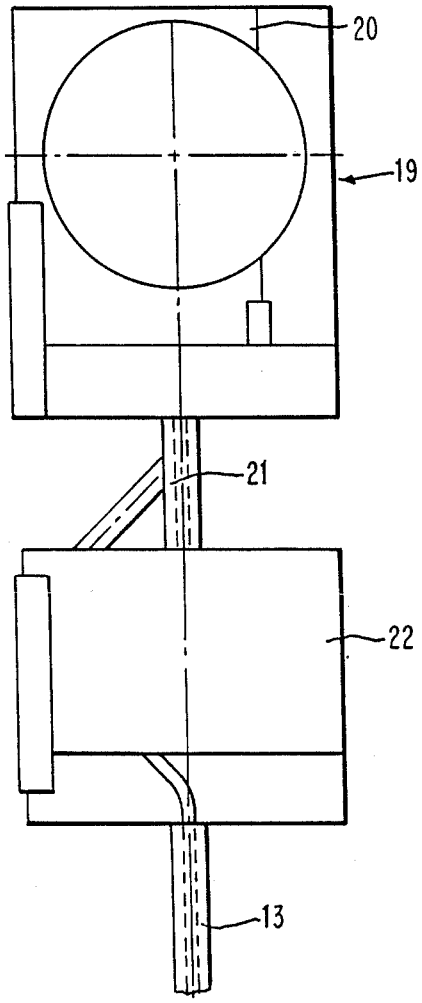
FIG. 2 is a side view of the cork magazine of the machine of FIG. 1, together with a channel for supplying the crown corks.

The corks 3 are supplied to the channel 13 from a cork magazine 19 in a position that corresponds to the subsequent processing position (FIG. 2). For this purpose, the cork magazine 19 has an upper magazine chamber 20 into which the corks 3 are introduced in a non-oriented manner. Connected to the bottom of the magazine chamber 20 is a sorting and turning device 21 with which the corks 3 are sorted and/or turned in such a way that after passing this sorting and turning device 21 the corks 3 pass into a collecting chamber 22 in which all of the corks have the correct orientation, which corresponds to the processing position, and from which the corks 3 pass into the channel 13.

During normal operation, in other words when there are no disruptions, the corks 3 are disposed directly after one another in the longitudinal direction of the channel 13. In other words, the crown edges of adjacent corks contact one another, so that via the opened discharge opening 17 and the cork transfer mechanism 12, a respective cork 3 will be transferred to each capping element 11 that moves past the cork transfer mechanism 12. In order, when a bottle 4 is missing, i.e. when there is an empty space on the feed star 2, to prevent a cork 3 from being transferred to the capping element 11 that corresponds to this missing bottle, there is provided at the feed star 2 a control or checking section which is embodied, for example, as a reflection light barrier unit and comprises a light emitter and receiver 23 as well as a reflector 24. If at a given point in time of the machine cycle of the capping machine 1 a respective pocket of the feed star 2 in which no bottle 4 is present moves by the monitoring section 23-25, a signal is delivered to an electronic control device 25 that preferably controls the capping machine pursuant to a prescribed program. A full period of the machine cycle $T_M$ is exactly that time within which the feed star 2 as well as the discharge star 8 advance by one pocket, or within which the machine table 6 advances by one deposit element 7. In the illustrated embodiment, this machine cycle $T_M$, which is formed of a square-wave pulse signal, is derived from a proximity switch 26 that is connected with the control device 20 and cooperates with a trip cam 27 that is disposed on a shaft that rotates synchronously with the drive of the capping machine 1. It is to be understood that other measures or means could also be used for the derivation or generation of the machine cycle $T_M$.

When viewed in the direction of rotation A of the feed star 2, the monitoring section 23, 24 is disposed ahead of the location 6' at which the bottles 4 are transferred from the feed star 2 to the machine table 6 by such an angular spacing that this spacing corresponds to the same number of periods of the machine cycle $T_M$ that is necessary for a cork 3 that is available at the discharge opening 17 to be transported from the plate 15 and subsequently from a capping element 11 to the transfer location 6'.

In order to monitor the orderly supply of corks 3 via the channel 13 to the cork transfer mechanism 12, and in order when an error occurs in this supply (when a cork or corks are missing in the channel 13 or when corks jam up in or ahead of the channel 13) to generate a disruption signal $S_s$ that in the illustrated embodiment effects an optical and/or audible alarm and also stops the drive of the capping machine 1, i.e. the drive motor 10, there is provided in the channel 13, as close to the discharge opening 17 as possible, a signal emitter 28. In the illustrated embodiment, this signal emitter 28 is formed by a reflection light barrier unit, although other suitable signal emitters, such as light barrier units that are embodied in a different manner, signal emitters that work on the induction principle, etc., could also be used. The signal emitter 28 is provided on the channel IS on one side thereof, relative to the central axis that extends in the longitudinal direction of this channel, in such a way that the signal emitter 28 registers or detects not only the corks 3 that pass the signal emitter, but also the empty spaces that result from the circular shape of the corks 3 to the side of the central axis of the channel 13 and between the corks 3, the peripheries or crown edges of which rest against one another.

Regardless of the starting position that the corks 3 have at the beginning of each period of a cycle signal relative to the signal emitter 28 in the channel 13, which cycle signal corresponds in the illustrated embodiment to the machine cycle $T_M$, and which position is essentially determined by the distance of the signal emitter 28 from the discharge opening 17, the emitted signal $S_G$ delivered by the signal emitter 28 changes at least two times during each complete period of the machine cycle $T_M$ during a correct operation. In other words, the digital emitted signal $S_G$ changes from one state into the other state and back into the first state. With such a signal $S_G$, which is supplied to the control device 25, the latter registers an orderly operation, i.e. an orderly supplying of the corks through the channel 13. The signal $S_G$ always has, for example, the high level "1" when a cork 3 passes by the signal emitter 28, and always has the low level "0" when there is a gap between two successive corks 3, or there are no corks 3, in the region of the signal emitter 28. It is to be understood that the relationships could also be reversed.

The control device 25 always registers a disruption if during a period of the cycle signal or the machine cycle $T_M$ no change of the signal $S_G$ from "1" to "0" to "1" or from "0" to "1" to "0" occurs, in other words, in the region of the signal emitter 28 no cork 3 has advanced in the channel 13 or no cork 3 is present there at all. The control device 25 then delivers at its output side the disruption signal $S_s$ for generating the optical and/or audible disruption indication, as well as for shutting off the motor 10 via an appropriate motor-disconnect element 29.

With the illustrated embodiment, the important thing is that the control device 25 becomes operative upon the change of the signal $S_G$ from "1" to "0" to "1" or "0" to "1" to "0" and generates the disruption signal $S_s$ only when during a complete period of the machine cycle $T_M$ such a change of the signal $S_G$ does not occur. In this way, a satisfactory operation of the monitoring unit, which is formed by the signal emitter 28 in conjunction with the control device 25, is for the most part assured independently of the distance of the signal emitter 28 from the discharge opening 17 as well as from that side of the channel 13 that is adjacent to this signal emitter, of the respective random position of the corks 3 in the channel 13, of the size of the corks 3 as well as of the speed with which the corks 3 slide further in the channel 13.

Figure 4:
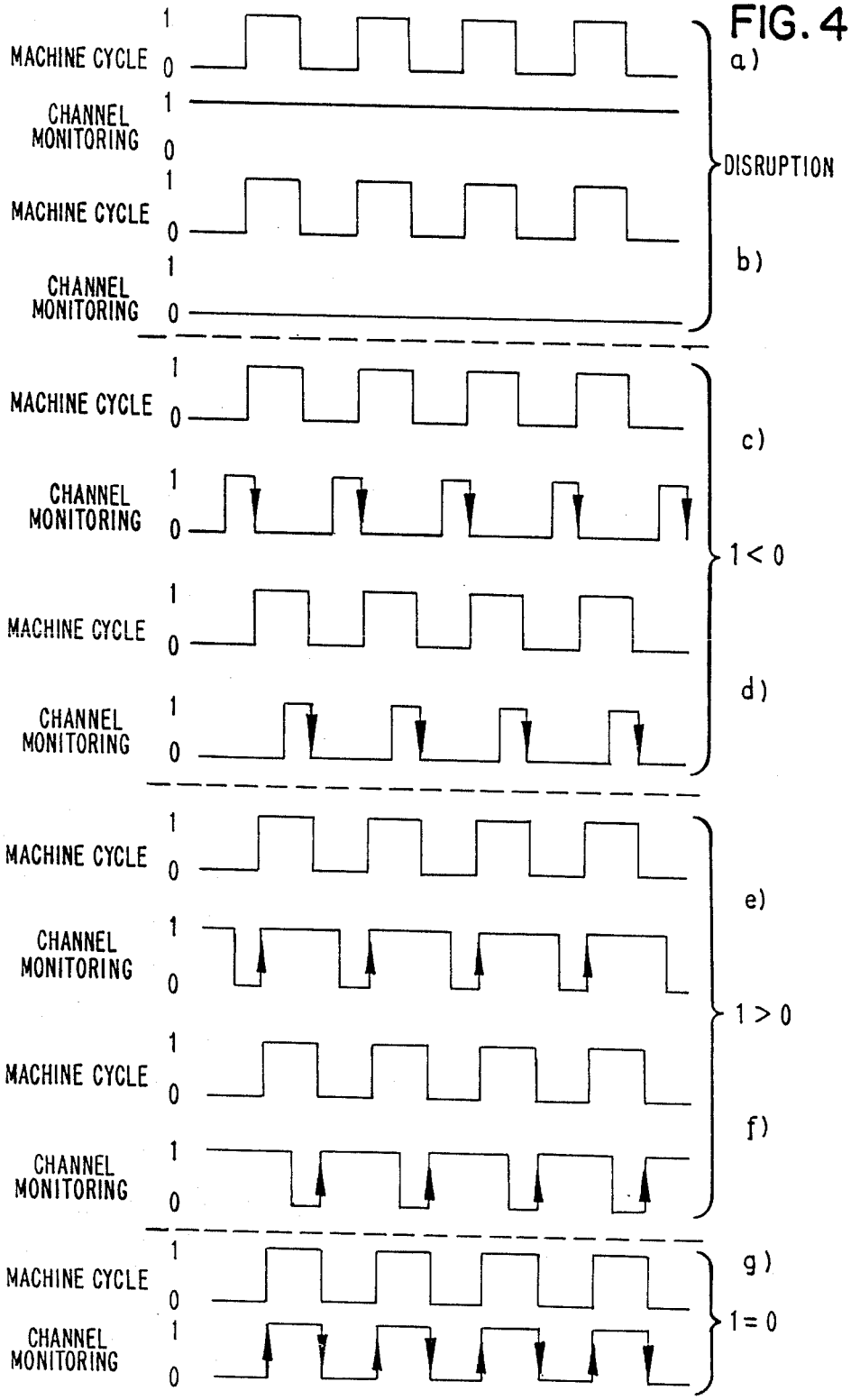
FIG. 4 shows seven positions that are of the chronological progress of possible emitted signals that are delivered from a signal emitter, in each case together with the working or machine cycle of the capping machine.

The possible signals $S_G$ that can be delivered by the signal emitter 28 and are to be evaluated by the control device 25 are shown in FIG. 4, in each case together with the cycle signal formed from the machine cycle $T_M$.

The positions "a" and "b" in FIG. 4 pertain to the situation of a disruption. In other words, no change of the signal $S_G$ is effected over one or even several periods of the cycle signal i e. this signal is either "1" or "0" in conformity with the random position of the corks 3 in the channel 13 or in conformity with a total failure of corks to be supplied to the channel 13.

The positions "c–g" in FIG. 4 pertain to the possible situations in which the signal $S_G$ from the control device 25 is evaluated for an orderly manner of operation. In particular, in the positions "c" and "d" the arrows indicate the registration of the signal $S_G$ from "1" to "0", in the positions "e" and "f" the arrows indicate the registration of the change of the signal $S_G$ from "0" to "1", and in the position "g" the arrows indicate the registration of the change of the signal $S_G$ from "0" to "1" as well as from "1" to "0".

Especially with the computer-controlled control device 25, which operates pursuant to a given program, with the illustrated embodiment the evaluation of the signal $S_G$ is effected in such a way that in a first cycle period, and in particular at the end of this cycle period, the random actual state of the signal $S_G$ is read by the control device 25 and is registered, and in that then in a second successive cycle period, which contains two cycles, there is determined whether the state of the signal $S_G$ has changed relative to this actual state and has thereafter returned to the actual state. The evaluation, and where a change is not present the generation of the disruption signal $S_s$, is then effected in a third cycle period.

The individual cycle periods correspond, for example, in each case to two cycles, i.e. a complete period of the cycle signal or of the machine cycle $T_M$. Where the control device 25 operates slowly, it might also be necessary to have more than three cycle periods for each monitoring mode. Furthermore, it is also possible for the first as well as the last cycle period of each monitoring mode to each comprise only one cycle or a half period of the cycle signal.

Figure 5:
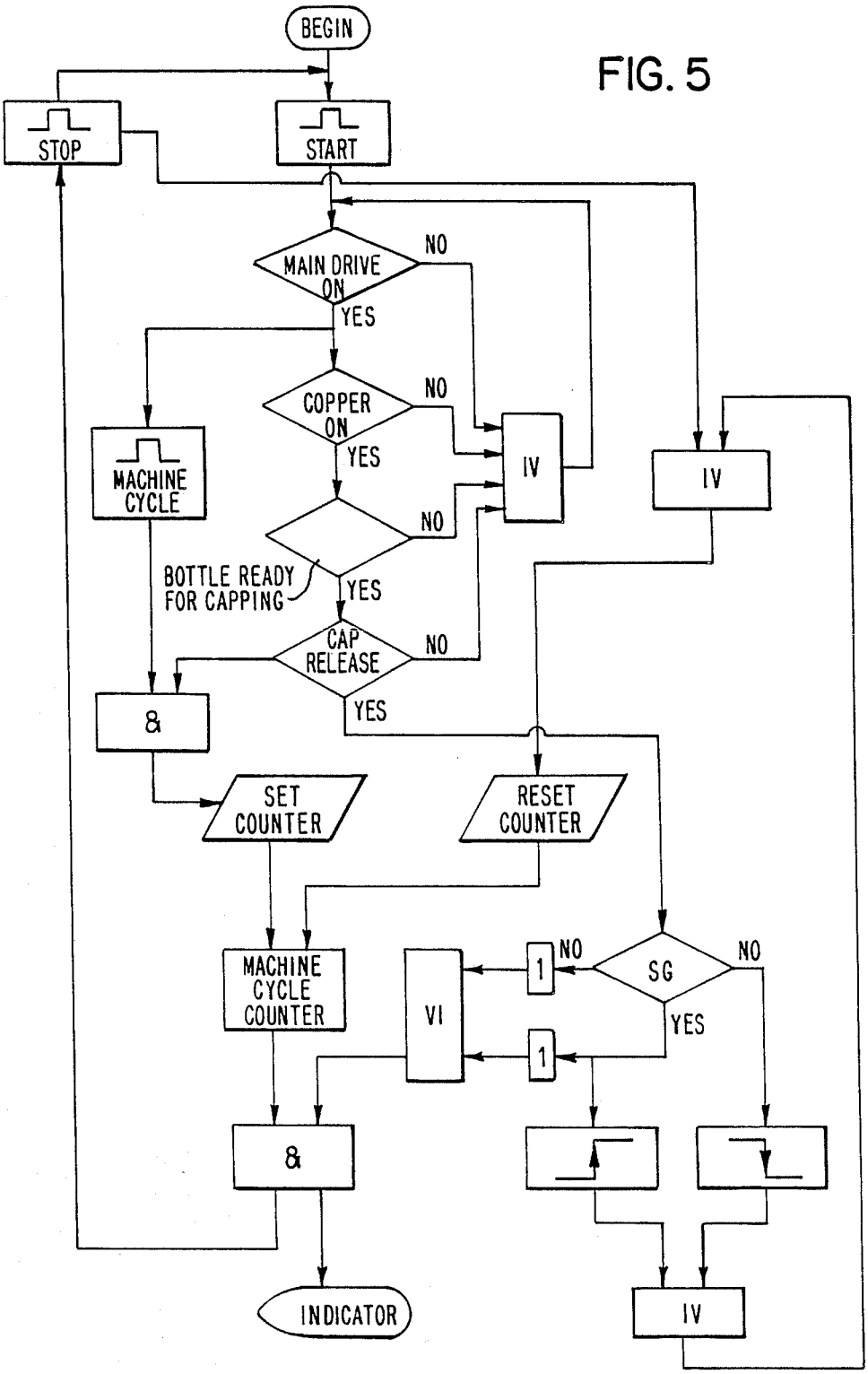
FIG. 5 is a flow diagram that explains the function of the control device.

The operation of the control device 25, which cooperates with the signal emitter 28, is shown in the expanded operation or flow chart of FIG. 5. Among other things, this chart also shows that the monitoring process, which is carried out with the signal emitter 28 in conjunction with the control device 25, is initiated only after a series of machine functions have been checked, and in particular only if the main drive (the drive motor 10) of the capping machine 1 as well as other functional elements (the capper) are switched on, if a respective bottle 4 that is ready to be capped is detected by the monitoring section 23, 24, and if the closure member 18 is in its opened position for cap release. Only when these functions are fulfilled is the initiation of the monitoring process effected via the signal emitter 28; otherwise, the aforementioned functions are again scanned.

For the monitoring process, the cycle signal (machine cycle $T_M$) or counting pulses derived herefrom, are fed to a cycle counter during cap release; after the counter has counted three cycle periods, in other words during the respective last cycle period of the monitoring mode, via an "AND" function, if in the preceding cycle period, in the manner described above, no double change of the signal $S_G$ delivered by the signal emitter 28 is determined, the disruption $S_s$, i.e. a shutting-off of the capping machine and an appropriate optical or audible disruption signal, issues.

After each determination of a change of the signal $S_G$ from "0" to "1" and vice versa, the cycle counter is reset to zero, as is also the case when the disruption signal $S_s$ is present and the capping machine is shut off.

Figure 3:
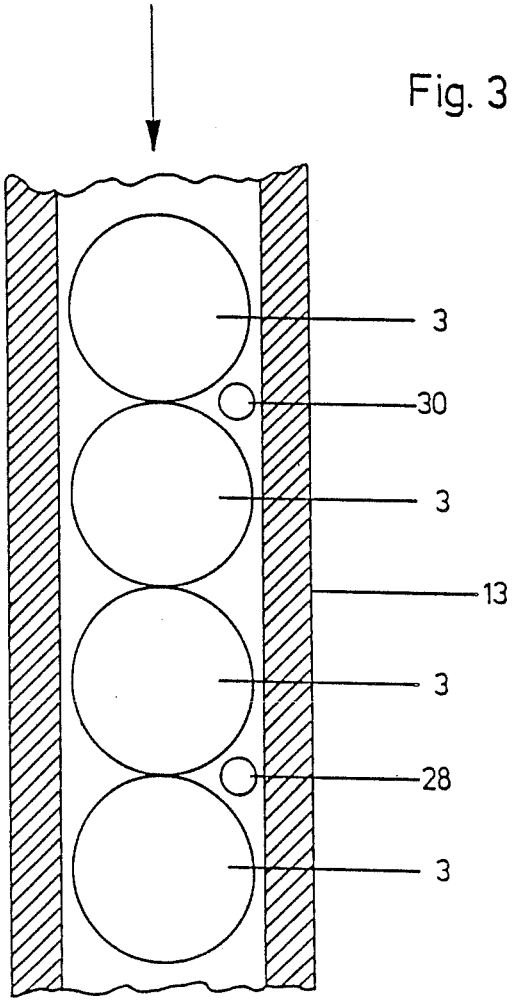
FIG. 3 is an enlarged view of a portion of the channel for supplying the crown corks, together with two signal emitters that are provided at this channel.

In FIG. 3, a further signal emitter 30, which is similar to the signal emitter 28, is provided on the channel 13. In the direction of movement of the corks 3, the signal emitter 30 is disposed prior to the signal emitter 28; in other words, the signal emitter 30 is spaced further from the discharge opening 17 than is the signal emitter 28. In a manner similar to the signal emitter 28, the signal emitter 30 cooperates with the control device 25 or with a portion thereof, and in particular for the purpose of generating an auxiliary disruption signal if, during two successive cycles or half periods of the cycle signal, i.e. the machine cycle $T_M$, the signal emitter 30 determines that no corks 3 have moved past it, for example because there are no corks in the collecting chamber 22 or because a back up of corks exists above the signal emitter 30. However, a shutting-down of the capping machine is not yet effected with this auxiliary disruption signal derived from the signal emitter 30; rather, this auxiliary disruption signal makes it possible to prepare the shutting-off of the capping machine 1 after a certain number of machine cycles or of corks withdrawn from the channel 13, with the number of these machine cycles up to the final shutting-off of the capping machine 1 being determined by the distance of the two signal emitters 28 and 30 from one another.

The process described has the advantage that the monitoring of the supply of corks 3 to the cork transfer mechanism 12 is reliably effected, independent of the respective rate at which a capping machine is being operated at any given time. With the method of the present invention it is also particularly possible to achieve a reliable monitoring of the supply of the corks 3 in a similar manner for low and very high output rates.

With the illustrated embodiment, the cycle signal is of the same frequency as the machine cycle $T_M$. However, the frequency of the machine cycle $T_M$ could also be greater than the frequency of the cycle signal, and in particular if with the capping machine 1 the corks 3 are supplied parallel to one another via several channels 13. In such a case, the frequency of the machine cycle $T_M$ is greater than the frequency of the cycle signal by a factor that corresponds to the number of channels 13.

The present invention is, of course, in no way restricted to the specific disclosure of the specification and drawings, but also encompasses any modifications within the scope of the appended claims.

What I claim is:

1. A method of monitoring the supply of cap members from a magazine or supply bin, via a channel, to the capping mechanism of a capping machine, whereby at least one signal emitter, which is provided at said channel, generates an emitted signal that changes as said cap members move past, with a disruption signal being derived from said emitted signal if said emitted signal does not change during a specified time interval; said method including the steps of:

deriving from said capping machine a cycle signal that corresponds to the working or machine cycle of said capping machine; and generating said disruption signal if in two successive first and second cycles, the sum of which corresponds to a full period of said cycle signal, no change of said emitted signal is determined.

2. A method according to claim 1, in which said generating step comprises generating said disruption signal if in two successive first and second cycles a double change of said emitted signal is not determined.

3. A method according to claim 1, which includes the steps of: in a first stage, in a cycle period that precedes said first cycle, registering the randomly present emitted signal as the first datum in the form of an actual state; in a second stage, during the following first and second cycles, determining as the second datum whether a change of said emitted signal has occurred; and in a third stage, during a cycle period that follows said second cycle, carrying out evaluation of said first and second data as well as possible generation of said disruption signal.

4. A method according to claim 3, in which said registering of said first datum, which corresponds to said random actual state, is effected at the end of said cycle period that precedes said first cycle.

5. A method according to claim 3, in which at least one of said cycle period that precedes said first cycle and said cycle period that follows said second cycle is at least a half period of said cycle signal.

6. A method according to claim 3, which includes the step of determining as said second datum a double change of said emitted signal when, during that period of said cycle signal that is formed by said first and second cycles, said emitted signal first has a value that is different from said actual state, and subsequently again assumes the value that corresponds to said actual state.

7. A method according to claim 1, which includes the step of effecting with said disruption signal an optical and/or audible disruption indication and/or a shutting-off of said capping machine.

8. A method according to claim 1, which includes the step of monitoring the supply of said cap members via two signal emitters that are provided at said channel one after the other in the direction of movement of said cap members, with each of said signal emitters delivering an emitted signal.

9. A method according to claim 8, which includes the step of, with said disruption signal derived from said emitted signal of that signal emitter that comes first in the direction of movement of said cap members, preparing and/or initiating the delivery of a disruption indication and/or the shutting-off of said capping machine in conformity with a number of machine working cycles that corresponds to the spatial distance between said two signal emitters.

10. An apparatus for monitoring the supply of cap members from a magazine or supply bin, via a channel, to the capping mechanism of a capping machine, whereby at least one signal emitter, which is provided at said channel, generates an emitted signal that changes as said cap members move past, with a disruption signal being derived from said emitted signal if said emitted signal does not change during a specified time interval; said apparatus comprising:

an electrical or electronic control device; and means for deriving from said capping machine a cycle signal, which corresponds to a working or machine cycle of said capping machine, and supplying this cycle signal to said control device, which then generates said disruption signal if in two successive first and second cycles, the sum of which corresponds to a full period of said cycle signal, said control device does not determine any change in said emitted signal.

11. An apparatus according to claim 10, in which said control device is adapted to generate said disruption signal if in two successive first and second cycles a double change of said emitted signal is not determined.

12. An apparatus according to claim 10, in which said control device is adapted: in a first stage, in a cycle period that precedes said first cycle, to register the randomly present emitted signal as the first datum in the form of an actual state; in a second stage, during the following first and second cycles, to determine as the second datum whether a change of said emitted signal has occurred; and in a third stage, in a cycle period that follows said second cycle, to effect evaluation of said first and second datum as well as possible generation of said disruption signal.

13. An apparatus according to claim 12, in which said control device is adapted to register said first datum, which corresponds to said random actual state, at the end of said cycle period that precedes said first cycle.

14. An apparatus according to claim 12, in which at least one of said cycle period that precedes said first cycle and said cycle period that follows said second cycle is at least a half period of said cycle signal.

15. An apparatus according to claim 12, in which said control device is adapted to determine as said second datum a double change of said emitted signal when, during that period of said cycle signal that is formed by said first and second cycles, said emitted signal first has a value that is different from said actual state, and subsequently again assumes the value that corresponds to said actual state

16. An apparatus according to claim 10, which includes means via which said disruption signal triggers an optical and/or audible disruption indication and/or triggers a device for shutting-off said capping machine.

17. An apparatus according to claim 10, which, to monitor said supply of said cap members, includes two signal emitters that are provided at said channel one after the other in the direction of movement of said cap members, with each of said signal emitters delivering an emitted signal.

* * * * *